United States Patent [19]

Johnson

[11] Patent Number: 4,922,641

[45] Date of Patent: May 8, 1990

[54] RECOIL PAD

[76] Inventor: Sam E. Johnson, 1519 Westbury Dr., Davison, Mich. 48423

[21] Appl. No.: 316,455

[22] Filed: Feb. 27, 1989

[51] Int. Cl.[5] ..... F41C 23/00

[52] U.S. Cl. ..... 42/74

[58] Field of Search ..... 42/71.01, 74

[56] References Cited

U.S. PATENT DOCUMENTS

| | | | |
|---|---|---|---|
| 935,822 | 10/1909 | Schmidt . | |
| 943,683 | 12/1909 | Johnson . | |
| 1,213,951 | 1/1917 | Ringsmith . | |
| 1,255,566 | 2/1918 | Pearson . | |
| 1,307,529 | 6/1919 | Werndl . | |
| 1,418,532 | 6/1922 | Caldwell . | |
| 1,785,977 | 12/1930 | Pruyn . | |
| 3,683,538 | 8/1972 | Locatelli . | |
| 3,714,726 | 2/1973 | Braun . | |
| 3,795,998 | 3/1974 | Kuhl . | |
| 4,439,943 | 4/1984 | Brakhage | 42/74 |
| 4,663,877 | 5/1987 | Bragg | 42/74 |

FOREIGN PATENT DOCUMENTS

| | | | |
|---|---|---|---|
| 17054 | of 1886 | United Kingdom | 42/74 |
| 1157 | of 1889 | United Kingdom | 42/74 |

*Primary Examiner*—Charles T. Jordan
*Assistant Examiner*—Richard W. Wendtland
*Attorney, Agent, or Firm*—Krass & Young

[57] ABSTRACT

The present invention is an improved recoil pad for attachment to the butt end of a firearm's stock. A series of springs, preferably helical, are utilized to reduce the transfer of recoil energy to the shooter. Interior air is released through air channels to reduce the forces opposing compression of the recoil pad. Further, the pad utilized compressible foam to aid in overall compressibility.

12 Claims, 2 Drawing Sheets

RECOIL PAD

FIELD OF THE INVENTION

The present invention relates to improved recoil reduction pad for placement on the butt end of a shoulder weapon's stock.

BACKGROUND OF THE INVENTION

Shoulder weapons, such as shotguns and rifles, are well known in the industry. Since their conception, attempts have been made to increase the size or velocity of their projectiles. Continuing efforts have been directed to flattening trajectories, increasing range and retaining energy down-range. To achieve these goals it is frequently necessary to increase muzzle energy.

Increased muzzle energy results in inherent drawbacks. Newton's Laws of Motion establish that increases in the muzzle energy of the projectile, cause an increase in the amount of force which is directed rearward through the stock into the shoulder of the shooter. Recoil energy increases proportionately with projectile energy. A two hundred grain projectile traveling at two thousand feet per second possesses twice the energy of a one hundred grain bullet at the same speed. It also has twice the recoil energy.

Efforts to increase the energy of projectiles, resulted in similar efforts to decrease the amount of recoil. Layers of clothing, between the solid stock and the shooters shoulder, gave little relief from large amounts of recoil. Pads, placed on the butt end of the stock, have emerged as a practical means for reducing the transfer of recoil energy to the shooter. The present invention provides an improvement upon the existing recoil pads.

SUMMARY OF THE INVENTION

The present invention is an improved recoil pad. A series of helical springs surrounded by a foam material are used to absorb and delay the transfer of recoil energy to the shooter. The springs and foam material are sandwiched between a pair of rigid or semi-rigid plates. One such plate is attached to the stock of the shoulder weapon. The other plate effectively forms the rearmost portion of the weapon. Thus, in operation, the invention is positioned between the stock and the shoulder of the shooter.

The present invention absorbs recoil energy through overall compression of the pad. The pad also distributes transmitted recoil energy in time which further reduces apparent or perceived recoil.

In addition to the series of helical springs, air channels and resilient foam material are utilized to control the compression of the pad. Helical springs provide a progressively increasing resistance to the recoil force. Air chambers house these helical springs. The air channels, connected to the interior air chambers, control the amount of air released from the interior of the pad. The channels allow release of portions of the chamber interior air to regulate the compression of the pad. Additionally, the composition of the foam can be regulated to further determine air transmission and rate of compression.

Overall, the invention operates to absorb recoil energy as the pad compresses. Additionally, the recoil energy that is transmitted is distributed in time to further decrease apparent recoil. A solid stock will transmit recoil energy in a single moment. The recoil pad of the present invention allows transmission of energy progressively.

It is an object of the present invention to provide a recoil suppression pad which has improved energy absorption characteristics.

It is a further object of the present invention to provide variable energy absorption characteristics based upon the composition and structure of the pad.

BRIEF DESCRIPTION OF THE DRAWINGS

With these and other objects in view, the invention consists of certain novel features as will be hereinafter fully described, and, in which, the separate parts are designated by suitable reference characters in each of the views, and in which.

DETAILED DESCRIPTION

Figure 1:
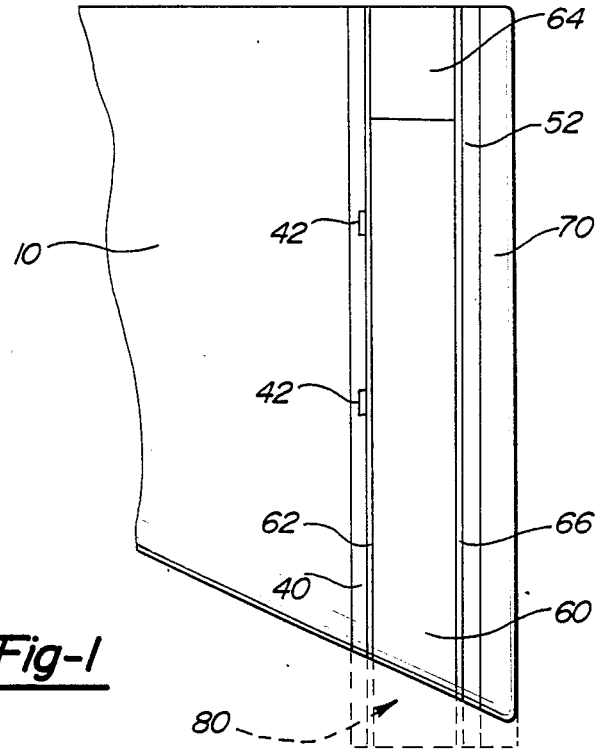
FIG. 1 is a side view of the outside of the improved recoil pad.

FIG. 1 shows the side view of the outside of the improved recoil pad and the relative dimensions of each of the invention's components. The invention is attached to standard firearm stock 10. Proceeding longitudinally away from firearm stock 10, stock plate 40 is positioned proximate to stock 10. A pliant foam sandwich, composed of foam plates 62 and 66, firm foam filling 64 and soft foam filling 60, is located between stock plate 40 and end plate 52. Finally, shoulder plate is attached to end plate 52.

FIG. 1 also shows an area 80 represented by dashed lines. This represents the oversized nature of the pad as produced, which allows the invention to conform to a variety of stock 10 shapes. This excess area 80 is ground away to conform to the stock size and shape of intended firearm. As this step may be performed by the user, an outline is placed on the invention indicating maximum allowable extent of grinding. This prevents the installer from penetrating the inner pad mechanisms while allowing the pad to be modified to fit a variety of gun stock sizes.

Figure 2:
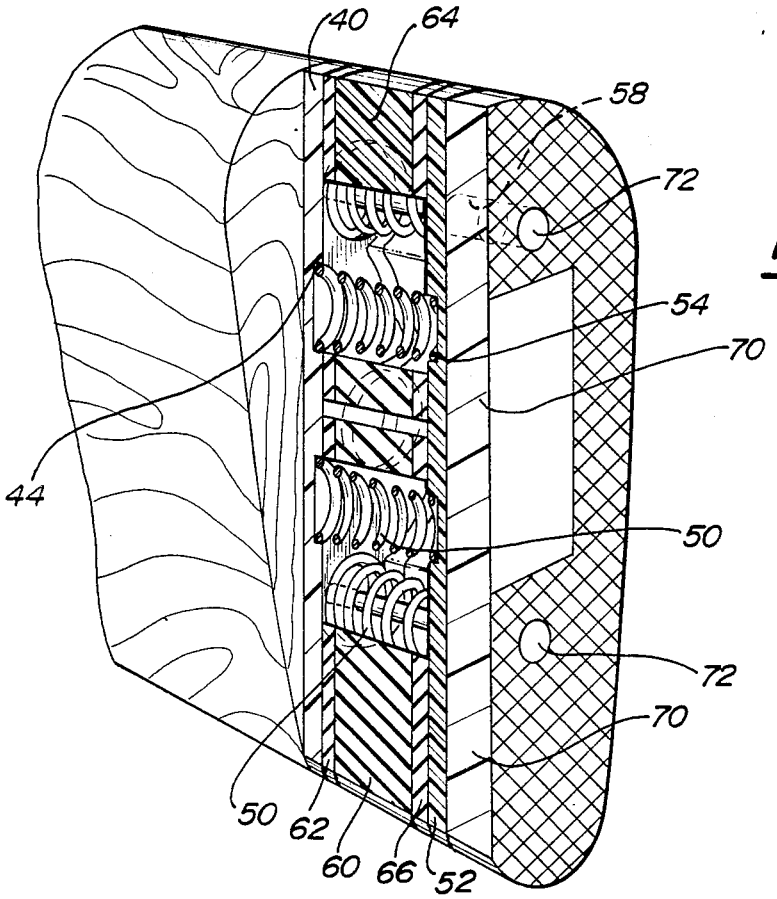
FIG. 2 is a perspective cutaway view of the improved recoil pad disclosing relative positions of internal parts.

FIG. 2 shows a perspective cut away view of the improved recoil pad showing the relative position of inner pad mechanisms. In operation, stock plate 40 abuts the end of the firearm stock. In the preferred embodiment, helical springs 50 attach to annular grooves 44 in stock plate 40. Additionally, the springs 50 attach to circular grooves 54 in end plate 52. In this manner, the helical springs 50, physically separate stock plate 40 and end plate 52.

Surrounding the springs 50, a foam sandwich, preferably made of neoprene, is located between stock plate 40 and end plate 52. This foam sandwich is composed of soft foam filling 60 and firm foam filling 64. Additionally, thin bottom foam plate 62 and top foam plate 66 are utilized to abut stock plate 40 and end plate 52 respectively. Bottom foam plate 62 and top foam plate 66 also serve to further secure soft foam filling 60 to firm foam filling 64. Foam plates 62 and 66 are composed of approximately 1/16" firm neoprene foam. Firm foam filling 64 is utilized on the extreme upper portion of the pad. This provides for improved wearing qualities and allows the firearm to be placed in an upright storage position. The usual firearm storage position places the majority of the weight of the firearm on the upper portion of the recoil pad, causing partial compression of that portion. The firm foam filling 64 is utilized to withstand extended compression periods. The soft foam filling 60 is utilized for its compressibility.

Proceeding longitudinally away from the firearm, shoulder plate 70 abuts end plate 52. After proper assembly, stock plate openings 48 are aligned with end plate openings 58, shoulder plate openings 72 and the center of the respective helical springs 50. The improved recoil pad is then attached to the firearm stock through conventional screw means positioned in the aligned openings. Shoulder plate 70 is preferably made of urethane having striations on its outside surface. These striations aid in maintaining proper firearm positioning when is use.

Figure 3:
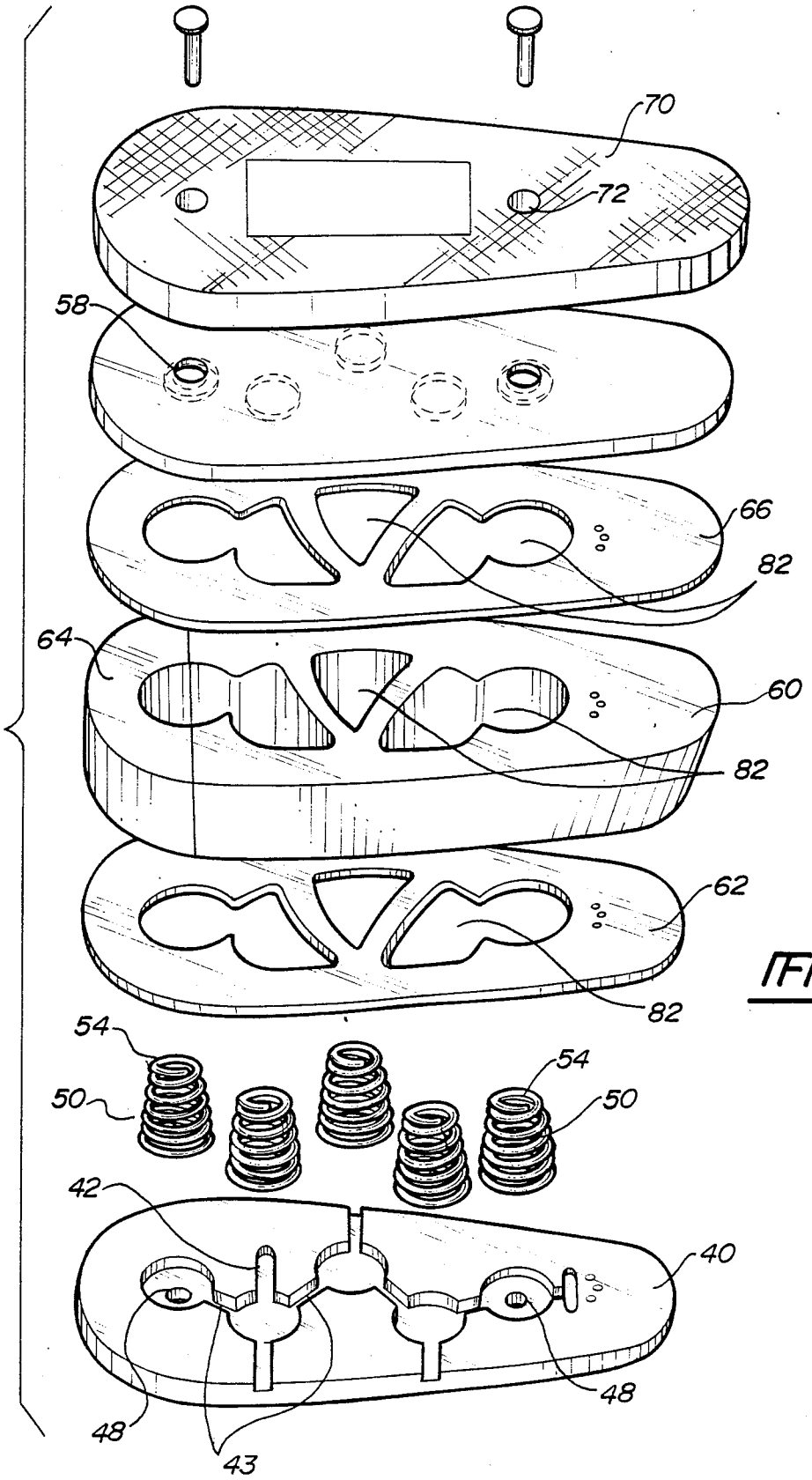
FIG. 3 is an exploded view of the invention, including the inward facing side of stock plate 40.

FIG. 3 shows an exploded view of the invention. The inward facing side of stock plate 40 is illustrated at the bottom of FIG. 3. Five (5) staggered annular grooves 44 of sufficient diameter to accept one end of helical springs 50 are positioned as shown. A plurality of channels 42 are cut into the inside face of stock plate 40. These are perpendicular to the major axis of compression of helical springs 50, and extend to the middle three annular grooves 44. One end of each of these channels 42 open to the outside edge of stock plate 40 as shown. Channels 42 may extend through annular grooves 44. Additional channels 43 are located between annular grooves 44 which do not extend to the outside edge of stock plate 40. The network of channels 42 and channels 43 connect the air chambers of void areas 82 formed in the foam sandwich by helical springs 50 to the outside air. This prevents forces opposing compression due to entrapped air. The stock plate openings 48, previously described, are also shown. Stock plate 40 is preferably composed of a polycarbonate material.

In the preferred embodiment five (5) helical springs 50 are utilized in a staggered configuration as shown. This arrangement effectively balances the compression and decompression forces during utilization.

With reference to FIG. 3, the various parts of the invention are assembled as follows. The ends of helical springs 50 are ground flat in a plane perpendicular to the major axis of compression. The larger end of each helical spring 50 is treated with a catalyst coated with urethane adhesive and pressed into one of the annular grooves 44 of stock plate 40. The smaller ends of the helical springs 50 are treated with a catalyst and coated with urethane adhesive in similar fashion.

The foam sandwich is formed and a plug conforming roughly to the end plate dimensions is cut therefrom. Preferably, the plug possesses central void areas 82 as shown on FIG. 3. These void areas 82 are dimensioned to accommodate the helical springs 50. Both outside surfaces of the foam plug are coated with the adhesive and placed over the helical springs 50 attached to stock plate 40. End plate 52 is positioned over the plug with helical springs centered in circular grooves 54. The assembly is then compressed until the adhesives have cured. Shoulder plate 70 is attached with adhesives to the outside face of end plate 52, aligning shoulder plate openings 72 with end plate openings 58. The resulting assembly can be ground to conform to a variety of stocks, being attached through screw means 59 Passing within the aligned openings.

The performance of the pad is regulated using at least one of several methods. Confined air in the recoil pad tends to oppose compression of the recoil pad. The channels 42 provide a method for allowing controlled escape of this air from the cavities formed by the foam sandwich and the plates 40 and 52. By regulating the cross section of the channel 42, the amount of air released during the action of the pad is effectively controlled. In addition, the foam sandwich constitutes a compliant material. Changes in the properties of the compliant material can effect the resilience of the foam and its resistance of compression. Preferably, firm foam filling 64 is utilized only as necessary to maintain effective wearing qualities. The majority of the foam sandwich is composed of the more compressible soft foam filling 60. The amount of foam, in terms of overall thickness and dimension also can be regulated to achieve similar results within the allowable dimensions for a particular shooter and firearm. Further, the hardness, shape and diameter of the springs 50 can be easily modified to regulate the recoil absorbing effect of the pad. In the preferred embodiment, springs 50 are helically designed to achieve a progressive increase in the amount of resistance offered by the spring as the pad compresses. However, cylindrical springs may also be used in certain applications.

Thus, the amount of recoil force absorbed by the invention can be regulated by increasing or decreasing the amount of compression achieved. This can be varied to accommodate different caliber firearms and different shooters needs. By providing for more compression, and therefore energy absorption, the invention can reduce transmitted recoil energy. Additionally, any transmitted recoil energy is transmitted over a period of time which further reduces apparent recoil.

Having thus disclosed my invention in detail, it would be obvious to one skilled in the art that variations and modifications may be made to the invention as described, and yet lie within the scope of the present invention, which I claim as follows:

1. A pad for absorbing the recoil of a projectile fired from a weapon having a stock comprising:

a first rigid plate;

a plurality of coiled springs having first and second ends, one surface of said first rigid plate being attached to said first end of said plurality of coiled springs, wherein the axis of compression of said springs is perpendicular to said one surface;

a second rigid plate attached to the second end of said springs opposite said first plate;

a compressible foam material surrounding said plurality of springs, and located between said first and second plates, said compressible foam material including a upper firm foam section and a lower soft foam section; and means for attachment of said pad to the end of said stock of said weapons.

2. The invention as described in claim 1, wherein said plurality of springs are helical.

3. The invention as described in claim 1, wherein said compressible foam material further includes a first thin semi-rigid foam layer and a second thin semi-rigid foam layer disposed on opposed lateral surfaces of the combination of said upper firm foam section and said lower soft foam section.

4. The invention as described in claim 1, wherein at least one of said rigid plates contains at least one groove on the surface of said plate to aid in attachment to said springs.

5. The invention as described in claim 4, wherein said at least one of said rigid plates contains at least one channel connecting said at least one groove to at least one edge of said plate.

6. The invention of claim 1, wherein said plurality of coiled springs comprise a plurality of more than two coiled springs disposed in a staggered configuration.

7. The invention of claim 1, wherein said first rigid plate is formed of a polycarbonate.

8. The invention of claim 7, wherein said second rigid plate is formed on a polycarbonate.

9. A pad for absorbing the recoil of a projectile fired from a weapon having a stock, comprising:

a first rigid plate, having one surface which includes a plurality of annular grooves, further including a plurality of channels connecting said annular grooves to at least one edge of said plate;

a plurality of helical springs having first and second ends, said first end being attached to said one surface of first rigid plate through interaction with said annular grooves, wherein said axis of compression of said springs is perpendicular to said one surface;

a second rigid plate attached to said second end of said plurality of helical springs opposite said first plate;

a compressible foam sandwich, comprised of a thick foam layer, said thick foam layer having one end composed of a firm compliant foam positioned relative to the top of said stock and the other end composed of soft compliant foam positioned relative to the bottom of said stock, a pair of thin semi-rigid foam layers disposed on opposed lateral surfaces of said thick foam layer, said compressible foam sandwich surrounding said plurality of helical springs and located between said first and second plates; and means for attachment of said pad to the end of said stock of said weapon.

10. A pad for absorbing the recoil of a projectile fired from a weapon having a stock, said pad being attached at the end of said stock and including a layer of foam material wherein the improvement comprises a firm compliant foam section disposed relative the top portion of said stock and a soft compliant foam section disposed substantially along the remainder of said stock end.

11. The invention of claim 10, wherein said pad further includes a pair of thin semi-rigid foam layers, each disposed on opposite sides of said foam layer to further secure said firm compliant foam section and soft compliant foam section together.

12. A pad for absorbing the recoil of a projectile fired from a weapon having a stock, comprising:

a first rigid plate;

a plurality of more than two coiled springs having first and second ends, one surface of said first rigid plate being attached to said first end of said plurality of coiled springs, wherein the axis of compression of said springs is perpendicular to said one surface, said plurality of coiled springs disposed in a staggered configuration;

a second rigid plate attached to the second end of said springs opposite said first plate;

a compressible foam material surrounding said plurality of springs, and located between said first and second plates; and means for attachment of said pad to the end of said stock of said weapons.

* * * * *